US010426306B2

(12) United States Patent
Isley et al.

(10) Patent No.: US 10,426,306 B2
(45) Date of Patent: Oct. 1, 2019

(54) BRUSHBAR, CLEANER HEAD AND METHOD OF MANUFACTURE OF A BRUSHBAR

(71) Applicant: Dyson Technology Limited, Wiltshire (GB)

(72) Inventors: David Andrew Isley, Gloucester (GB); Joshua Thomas Mutlow, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 312 days.

(21) Appl. No.: 15/410,429

(22) Filed: Jan. 19, 2017

(65) Prior Publication Data

US 2017/0209008 A1 Jul. 27, 2017

(30) Foreign Application Priority Data

Jan. 22, 2016 (GB) ..... 1601216.3

(51) Int. Cl.
*A47L 9/04* (2006.01)
*A46D 3/00* (2006.01)
(Continued)

(52) U.S. Cl.
CPC ..... *A47L 9/0477* (2013.01); *A46B 13/006* (2013.01); *A46D 3/00* (2013.01); *A47L 5/26* (2013.01)

(58) Field of Classification Search
None
See application file for complete search history.

(56) References Cited

U.S. PATENT DOCUMENTS 1,866,118 A 7/1932 Lowry
1,918,360 A 7/1933 White
(Continued)

FOREIGN PATENT DOCUMENTS

DE 197 28 380 1/1999
DE 200 01 579 4/2001
(Continued)

OTHER PUBLICATIONS

Search Report dated Jul. 14, 2016, directed to GB Application No. 1601216.3; 1 page.
(Continued)

*Primary Examiner* — Brian D Keller
(74) *Attorney, Agent, or Firm* — Morrison & Foerster LLP

(57) ABSTRACT

A brushbar including: a body having a channel extending in the longitudinal direction and a retaining feature provided along each side of the channel and spaced away from a bottom, wherein a depth of the channel decreases in the longitudinal direction of the channel; an agitator element that includes a flexible strip and an agitator, wherein the flexible strip is disposed in the channel and extends between each retaining feature and the bottom of the channel such that the retaining features retain the flexible strip in the channel and the agitator extends radially from the channel; and a shim disposed between the flexible strip and the bottom of the channel such that the flexible strip abuts each retaining feature, wherein a thickness profile of the shim decreases in the longitudinal direction by an amount corresponding to the decrease in the depth of the channel.

17 Claims, 6 Drawing Sheets

(51) Int. Cl.
*A47L 5/26* (2006.01)
*A46B 13/00* (2006.01)

(56) References Cited

U.S. PATENT DOCUMENTS

| | | | | | |
|---|---|---|---|---|---|
| 2,261,781 | A | * | 11/1941 | Smellie | A47L 5/34 15/182 |
| 2,271,556 | A | | 2/1942 | Boyle et al. | |
| 2,767,418 | A | * | 10/1956 | Lombardi | A46B 13/005 15/183 |
| 3,225,374 | A | | 12/1965 | Daley et al. | |
| 3,820,189 | A | * | 6/1974 | Roth | A47L 9/02 15/400 |
| 3,909,871 | A | * | 10/1975 | Parker | A46B 13/005 15/182 |
| 4,772,373 | A | * | 9/1988 | Ebata | G01N 27/44756 204/618 |
| 5,495,634 | A | * | 3/1996 | Brundula | A47L 5/30 15/179 |
| 7,140,062 | B1 | | 11/2006 | Chen | |
| 2014/0000054 | A1 | | 1/2014 | Liffers et al. | |

FOREIGN PATENT DOCUMENTS

| | | |
|---|---|---|
| GB | 790826 | 2/1958 |
| GB | 2526512 | 12/2015 |
| JP | 4-314411 | 11/1992 |
| JP | 8-38399 | 2/1996 |
| JP | 2005-46229 | 2/2005 |
| JP | 3642357 | 4/2005 |
| JP | 2007-195631 | 8/2007 |
| JP | 2008-61785 | 3/2008 |
| JP | 2015-109940 | 6/2015 |
| JP | 2015-198856 | 11/2015 |
| KR | 10-2011-0119881 | 11/2011 |
| KR | 10-2015-0094067 | 8/2015 |

OTHER PUBLICATIONS

International Search Report and Written Opinion dated Feb. 10, 2017, directed to International Application No. PCT/GB2016/053853; 9 pages.

* cited by examiner

BRUSHBAR, CLEANER HEAD AND METHOD OF MANUFACTURE OF A BRUSHBAR

REFERENCE TO RELATED APPLICATIONS

This application claims the priority of United Kingdom Application No. 1601216.3 filed Jan. 22, 2016, the entire contents of which are incorporated herein by reference.

FIELD OF THE INVENTION

This invention relates to a brushbar, a cleaner head, a vacuum cleaner and a method of manufacturing a brushbar.

BACKGROUND OF THE INVENTION

Brushbars are used in vacuum cleaners in order to agitate dirt on a surface being cleaned. Agitation helps lift dirt from a surface so that it can then be sucked up into a separator.

An example of a brushbar is provided in GB2526512A. The brushbar comprises a cylindrical body and two strips of bristles, which may comprises a strip of NYLON bristles and a strip of carbon fibre bristles. The strips of bristles extend in respective helixes about the cylindrical body. Typically, each strip of bristles comprises a strip of material to which the bristles are attached. Carbon fibre bristles may, for example, be secured to a strip of relatively stiff polymeric material by stitching. NYLON bristles are typically bonded to a flexible strip of fabric which itself may be NYLON. Channels having retaining lips on each of their respective sides are typically formed along a body of the brushbar. The bristle strips extend along the respective channels and are held in place by the retaining lips.

In order to assemble such a brushbar, each bristle strip must be threaded from one end along a channel. If the depth of the channel is too shallow, the force required to force a strip along the channel risks deforming the bristle strips and, in the case of NYLON strips which are typically more flexible than the carbon fibre strips described in the example above, can make it very difficult and potentially impossible to completely insert the strip into a channel Conversely, if the depth of the channel is too deep, the spacing between the underside of each strip and bottom of each channel is such that the strip moves in the radial direction during use of the brushbar. This makes floor clearance difficult to maintain and, in the case of the NYLON bristles which tend to be stiff, can result in a bristle strip being pushed up into the channel thereby reducing the amount by which the bristles penetrate a carpeted surface, and adversely affecting pick-up performance.

A brushbar which does not have the drawbacks mentioned above is therefore desirable.

SUMMARY OF THE INVENTION

According to a first aspect of the invention, there is provided a brushbar for a cleaner head comprising: a brushbar body having a channel which extends generally in the longitudinal direction of the brushbar and at least one retaining feature provided along a portion of each side of the channel and spaced away from a bottom of the channel, the channel having a varying portion in which a depth of the channel decreases from one end of the varying portion in the longitudinal direction of the channel; an agitator element comprising a flexible strip and an agitator, the flexible strip is disposed in the channel and extends between each retaining feature and the bottom of the channel such that the retaining features retain the flexible strip in the channel and the agitator extends radially outwardly from the channel; and a shim disposed between the flexible strip and the bottom of the channel such that the flexible strip is held in abutting contact with each retaining feature, wherein the shim has a varying portion in which the thickness profile decreases in the longitudinal direction of the shim by an amount which corresponds to the decrease in the depth of the channel.

The shim and flexible strip cooperate such that the flexible strip is held against the retaining features. This prevents the bristle strip from moving in a radial direction during use, and so improves penetration of carpets etc. Furthermore, the brushbar is easy to assemble since the force required to insert the bristle strip along the shim into the channel is relatively low. It will be appreciated that the flexible strip, channel, retaining features and/or shim need not have a uniform cross section. For example, the varying portion on the shim could have a cross-section (as viewed along the length of the shim) which is stepped or tapered, but the thickness profile of the cross-section decreases along the length of the varying portion.

The rate of change in thickness profile of the varying portion of the shim in the longitudinal direction of the shim may be between 0.001 mm/mm to 0.01 mm/mm, and preferably between 0.002 mm/mm and 0.005 mm/mm, such as 0.0026.

The varying portion of the channel may extend along at least half of the length of the channel, and preferably at least 75% of the length of the channel. Preferably, the varying portion of the shim extends along the whole length of the varying portion of the channel.

The thickness profile of the flexible strip may be substantially constant along the length of the flexible strip.

The retaining features may comprise a first retaining lip which extends along at least part of one side of the channel and a second retaining lip which extends along at least part of the opposite side of the channel.

The distance between each retaining lip and the bottom of the channel along the varying portion of the channel may decrease in the longitudinal direction of the channel.

The channel has an opening towards one end on the channel for insertion of the flexible strip and the shim into the channel. The opening may be at the end of the channel of formed as a wider portion of a slot between the retaining features.

The distance between the bottom of the channel along the varying portion and each retaining feature may decrease in the direction away from the opening.

The brushbar may further comprise a retainer secured at the open end of the channel in order to secure the agitator strip and shim within the channel. The retainer may comprise a cap secured to the end of the brushbar body.

The width of the varying portion of the channel may decrease in the longitudinal direction of the channel. The width of the varying portion of the shim may decrease along the varying portion of the shim by an amount which corresponds to the decrease in the width of the channel.

The agitator may comprise bristles which are secured to the flexible strip. The flexible strip comprises a fabric, for example a non-woven fabric. The flexible strip may be made of a polymer such as NYLON. The thickness of the flexible strip may be less than 1 mm, for example lea than 0.5 mm.

The channel may extend in a helix through at least 180 degrees.

According to a second aspect of the invention there is provided a cleaner head for a vacuum cleaner comprising a brushbar in accordance with the first aspect of the invention.

According to a third aspect of the invention there is provided a cleaning appliance comprising a brushbar in accordance with the first aspect of the invention.

According to a fourth aspect of the invention, there is provided a method of manufacturing a brushbar comprising the steps: providing a brushbar body having a channel which extends generally in the longitudinal direction of the brushbar and at least one retaining feature provided along a portion of each side of the channel and spaced away from a bottom of the channel, the channel having a varying portion in which a depth of the channel decreases from one end of the varying portion in the longitudinal direction of the channel; inserting an agitator element comprising a flexible strip and an agitator into the channel such that the flexible strip is disposed in the channel and extends between each retaining feature and the bottom of the channel and the agitator extends radially outwardly from the channel; inserting a shim between the flexible strip and the bottom of the channel such that the flexible is pressed into abutting contact with each retaining feature, the shim having a varying portion in which the thickness profile decreases in the longitudinal direction of the shim by an amount which corresponds to the decrease in the depth of the channel.

The brushbar may comprise one or more of the features of the brushbar in accordance with the first aspect of the invention.

The channel may have an opening towards one end of the channel through which the flexible strip and shim are inserted. The method may further comprise the step of securing a retainer at the open end in order to retain the agitator strip and the shim within the channel.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
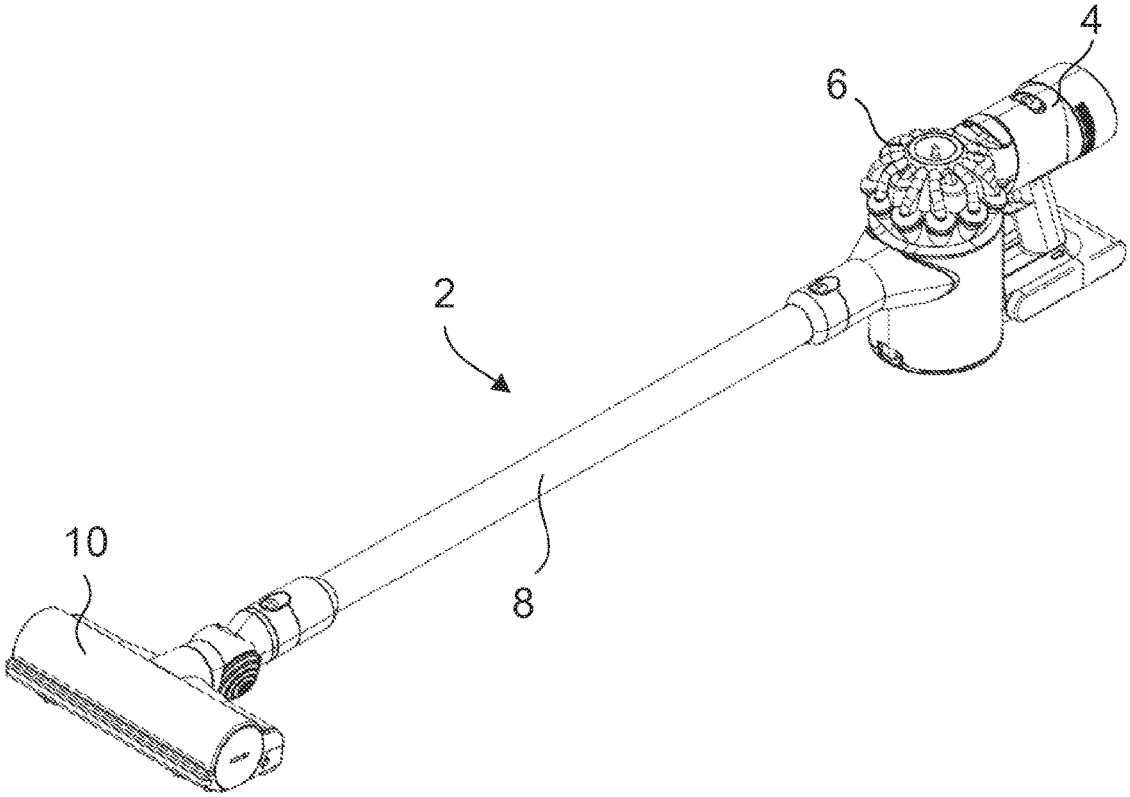
FIG. 1 shows a stick vacuum cleaner.

FIG. 1 shows a stick vacuum 2 cleaner comprising a main body 4, cyclonic separating apparatus 6, a wand 8 and a cleaner head 10.

Figure 2:
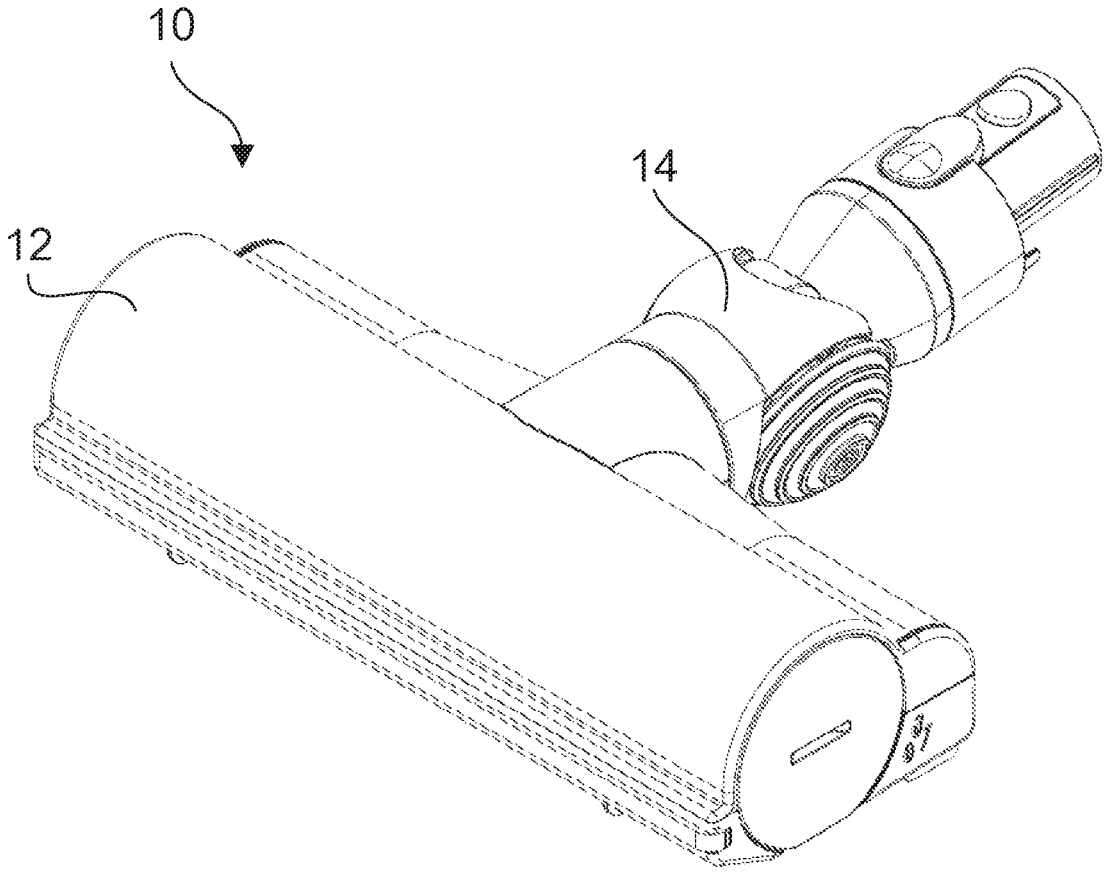
FIG. 2 shows the cleaner head of the stick vacuum cleaner shown in FIG. 1.

FIG. 2 shows the cleaner head 10 in isolation. The cleaner head 10 comprises a body 12, an articulated neck 14 which is rotatably connected to the body 12 and a brushbar 16 (not visible in FIG. 2, but shown in isolation in FIG. 3) housed within the body 12.

Figure 3:
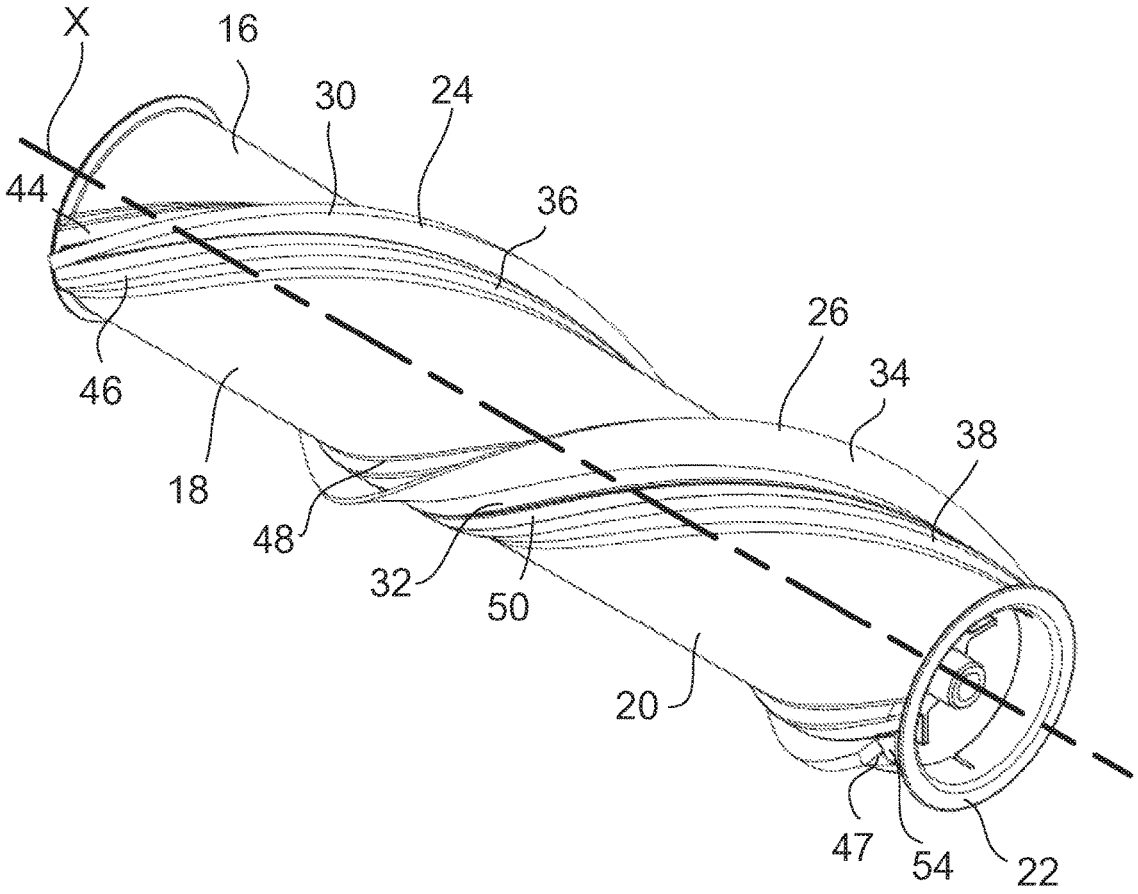
FIG. 3 shows a brushbar of the cleaner head shown in FIG. 2.

The brushbar 16 shown in FIG. 3 comprises a brushbar body 18 comprising a tubular portion 20 formed of a single piece of material, an end cap 22, a first bristle strip 24 and a second bristle strip 26. The brushbar 16 has a longitudinal axis X.

Figure 5:
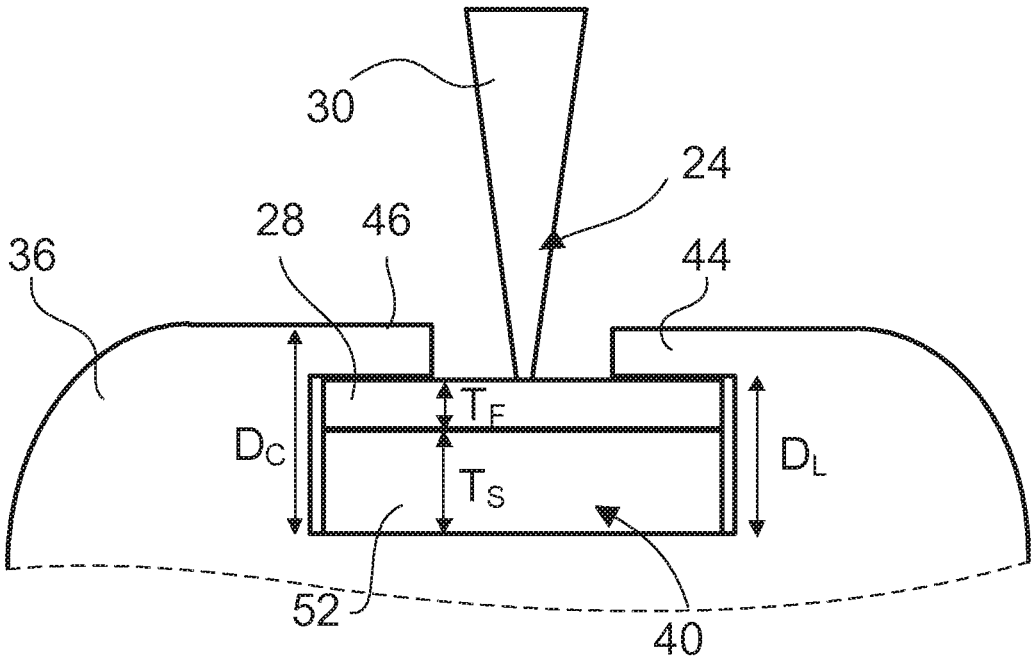
FIG. 5 is a schematic representation of a portion of the brushbar shown in FIG. 3 in section.
Figure 6:
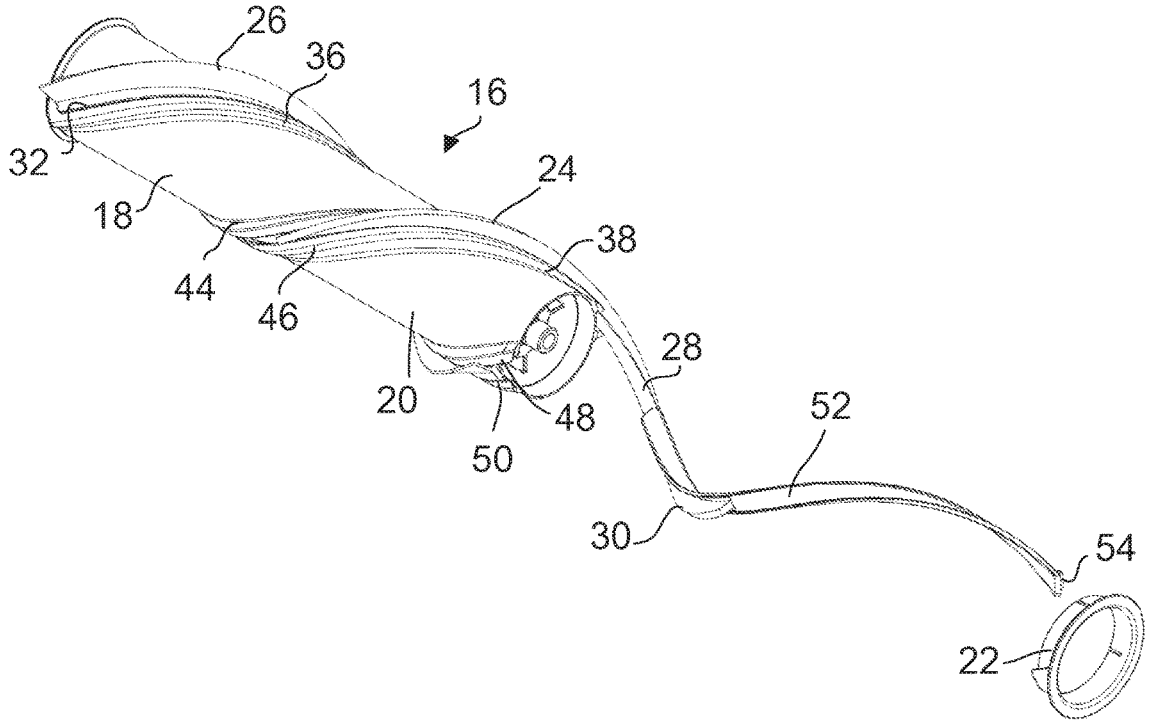
FIG. 6 is an exploded view of the brushbar shown in FIG. 3.

The first bristle strip 24 comprises a flexible strip 28, which is shown in FIGS. 5 and 6, formed from a fabric, such as a non-woven fabric, and a plurality of bristles 30 bonded to the flexible strip 28. The flexible strip 28 has a substantially constant thickness $T_F$ along its length. The thickness of the flexible strip 28 is such that the flexible strip 28 flexes under its own weight and cannot, for example, support itself when held at one end. The thickness of the flexible strip 28 is less than 0.5 mm. In the embodiment shown, the bristles 30 are made of NYLON.

The second bristle strip 26 comprises a stiff strip 32 which is relatively stiff compared with the flexible strip 28, such as a strip made of plastic, and a plurality of bristles 34 that are secured to the stiff strip 32 by stitching. In the embodiment shown the bristles are carbon fibre bristles.

Figure 4:
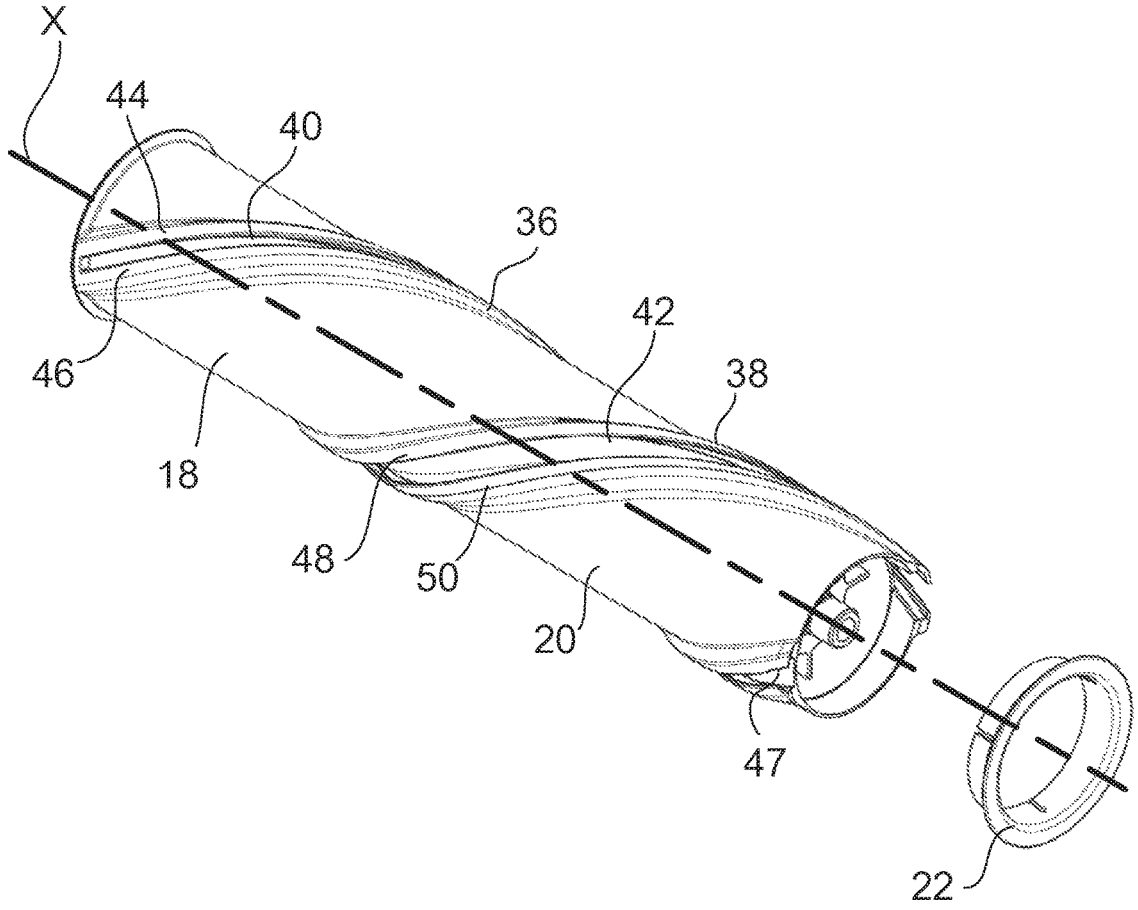
FIG. 4 shows an exploded view of a brushbar body of the brushbar shown in FIG. 3.

An exploded view of the brushbar body 18 in isolation in FIG. 4. The brushbar body 18 has first and second raised helical formations 36, 38 formed about the circumference of the brushbar body 18. Each formation 36, 38 extends through 360 degrees about the outer periphery of the brushbar body 18. The formations 36, 38 are spaced apart from each other by 180 degrees so that they are diametrically opposite each other at any point along the longitudinal axis X of the brushbar 16.

Respective first and second channels 40, 42 are formed along the length of each formation 36, 38. The end of each channel 40, 42 adjacent the end cap 22 is open.

Retaining features in the form of first and second retaining lips 44, 46 extend along the upper edges of the first channel 40 respectively such that they overhang the first channel 40 to form a slot between the retaining lips 44, 46.

The first channel 40 has a depth $D_C$ that decreases from the open end, which is the nearest the end cap 22, along the length of the first channel 40. The rate of change in the depth $D_C$ of the first channel 40 along its length is substantially constant along the first channel 40. The rate of change in the depth $D_C$ along the length of the first channel 40 is between 0.001 mm/mm to 0.01 mm/mm, and preferably between 0.002 mm/mm and 0.005 mm/mm. The first and second retaining lips 44, 46 have a constant thickness profile along their length such that the distance $D_L$ between the lower surface of each retaining lip 44, 46 and the bottom of the first channel 40 decreases along the length of the first channel 40 away from the open end adjacent the end cap 22. Each retaining lip 44, 46 need not have a uniform thickness across its width, but the width profile of each retaining lip 44, 46 does not vary along its length. The second retaining lip 46 has a notch 47 in it adjacent the open end.

Third and fourth retaining lips 48, 50 extend along the upper edges of the second channel 42 such that they overhang the second channel 42 to form a slot between the retaining lips 48, 50. The depth of the second channel 42 is substantially constant along its length and the third and fourth retaining lips 48, 50 have a constant thickness profile such that the distance between the lower surface of each retaining lip 48, 50 and the bottom of the second channel 42 does not vary along the length of the second channel 42. The open end of the second channel 42 is adjacent the end cap 22.

As shown in FIG. 5, the first bristle strip 24 is located within the first channel 40 such that the side edges of the flexible strip 28 extend underneath the retaining lips 44, 46 respectively and the bristles 30 protrude outwardly from the first channel 40 through the slot formed by the retaining lips 44, 46. The first bristle strip 24 is therefore held captive within the first channel by the lips 44, 46.

A shim 52, shown in FIGS. 5 and 6, is disposed between the flexible strip 28 and the bottom of the first channel 40 such that the shim 52 holds the flexible strip 28 in abutting engagement with the undersides of the retaining lips 44, 46. The thickness $T_S$ of the shim 52 decreases in the direction away from the end cap 22. The shim 52 is therefore tapered along its length. The change in the thickness $T_S$ of the shim 52 corresponds to the change in the depth $D_C$ of the first channel 40. For a shim 52 having a length of 230 mm the thickness $T_S$ of the shim 52 may vary from 1.2 mm at the thicker end to 0.6 mm at the thinner end. The rate of change of thickness of the shim 52 in the longitudinal direction of the shim 52 can be between 0.001 mm/mm to 0.01 mm/mm, and preferably between 0.002 mm/mm and 0.005 mm/mm. The combined thickness $T_S$ of the shim 52 and the thickness $T_F$ of the flexible strip 28 is equal to the distance $D_L$ between the lower surface of each retaining lip 44, 46 and the bottom of the first channel 40 along the length of the first channel 40. The shim 52 has a tab 54 at the thickest end of the shim 52 which stands proud of the upper surface of the rest of the shim 52. It will be appreciated that the cross-section of the shim 52 need not be uniform. For a shim 52 having a non-uniform cross-section, the cross-sectional profile of the shim 52 corresponds to the cross-sectional profile of the portion of the first channel 40 which it occupies.

Assembly of the brushbar 16 will now be described with particular reference to FIG. 6.

Firstly, the stiff strip 32 of the second bristle strip 26 is inserted through the open end of the second channel 42 formed in the tubular portion 20 of the brushbar body 18 such that the edges of the strip of material 32 slide along the second channel 42 underneath the retaining lips 48, 50 until the second bristle strip 26 has been inserted completely through the open end of the second channel 42. Once fully inserted, the second bristle strip 26 is retained by the third and fourth retaining lips 48, 50 and the carbon fibre bristles 34 project radially outwardly from the brushbar body 18 through the slot formed between the retaining lips 48, 50. The thickness of the stiff strip 32 is equal to the distance between the lower surface of the third and fourth retaining lips 48, 50 and so the upper surface of the stiff strip 32 contacts the respective lower surfaces of the retaining lips 48, 50 and the lower surface of the stiff strip 32 contacts the bottom of the second channel 42 such that the stiff strip 32 forms a friction fit within the second channel 42.

Secondly, the flexible strip 28 of the first bristle strip 24 is inserted through the open end of the first channel 40 such that the edges of the flexible strip 28 slide along the first channel 40 underneath the first and second retaining lips 44, 46 and the bristles 30 protrude outwardly from the first channel 40 between the retaining lips 44, 46. The relatively large distance $D_L$ between the bottom of the first channel 40 and the underside of the retaining lips 44, 46 ensures that the first bristle strip 24 can be pushed or drawn along the entire length of the channel unimpeded (i.e. there is very little friction between the flexible strip 28 and the bottom of the first channel 40 or the lower surfaces of the retaining lips 44, 46). Once the flexible bristle strip 28 has been inserted completely into the first channel 40, the thinnest end of the shim 52 is inserted into the first channel 40 between the flexible strip 28 and the bottom of the first channel 40. As the shim 52 is inserted, the flexible strip 28 is pushed radially outwardly by the shim 52 towards the retaining lips 44, 46. As the shim 52 reaches the point of being completely inserted, it presses the flexible strip 28 against the underside of the lips 44, 46. It is only as the shim 52 pushes the flexible strip 28 against the retaining lips 44, 46 that any significant resistive frictional force between the shim 52 and the base of the first channel 40, is exerted on the shim 52. Consequently, the force exerted on the shim 52 need not be excessive and so likelihood of damaging the shim 52 or the flexible strip 28 during assembly is low. Once fully inserted, the tab 54 engages with the notch 47 formed in the second retaining lip 46. This prevents the shim 52, which is slightly shorter than the length of the first channel 40, from being pushed further into the first channel 40.

A benefit of the arrangement is that the flexible strip 28 can be very flexible since, unlike the stiff strip 32 of the second bristle strip 26, the flexible strip 28 need not be designed to withstand a frictional force as it is inserted into the first channel 40. The flexible strip 28 can also have a constant thickness. The bristle strip 26 can therefore be made using a fabrication process that is relatively simple and low cost. The arrangement is particularly beneficial when the length of the first channel 40 is relatively long in which case the relatively large frictional forces that would be generated by insertion of a bristle strip having frictional fit are avoided. This enable a much longer channel to be used than would otherwise be possible. In the embodiment shown, the shim 52 is stiffer than the flexible strip 28 and is of sufficient stiffness to ensure that it does not deform excessively as the shim 52 is pushed completely into the first channel 40.

A further benefit of the arrangement is that the shim 52 can be configured to provide a counter weight to the second bristle strip 26, which in the embodiment described is heavier than the first bristle strip 24. The shim 52 can therefore be used to balance the brushbar 16 about the longitudinal axis X.

Once the first and second bristle strips 24, 26 have been assembled with the tubular portion 20 of the brushbar body 18, the end cap 22 is secured in place at the end of the tubular portion 20. The end cap 22 may be a push fit and/or may be secured by gluing and/or welding. The end cap 22 holds the first and second bristle strips 24, 26 and the shim 52 in place within the channels 40, 42.

It will be appreciated that in alternative embodiments, shims could be used for both sets of bristle strips.

At least part of the first channel could have a width that decreases in the same direction as the depth of the first channel decreases and the width of the shim has a width which decreases by an amount which corresponds to the decrease in the width of the first channel. This would further aid insertion of the shim.

The invention claimed is:

1. A brushbar for a cleaner head comprising:

a brushbar body comprising a channel that extends in a longitudinal direction of the brushbar and at least one retaining lip provided along at least one side of the channel and spaced away from a bottom of the channel, the channel having a varying portion in which a depth of the channel decreases from one end of the varying portion in a longitudinal direction of the channel;

an agitator element comprising a flexible strip and an agitator, wherein the flexible strip comprises a fabric and has a maximum thickness of less than 1 mm, and wherein the flexible strip is disposed in the channel and extends between the at least one retaining lip and the bottom of the channel such that the at least one retaining lip retains the flexible strip in the channel and the agitator extends radially outwardly from the channel; and a shim disposed between the flexible strip and the bottom of the channel such that the flexible strip is held in abutting contact with the at least one retaining lip, wherein the shim has a varying portion in which a thickness of the varying portion of the shim decreases in a longitudinal direction of the shim by an amount which corresponds to the decrease in the depth of the channel.

2. The brushbar of claim 1, wherein a rate of change in the thickness of the varying portion of the shim in the longitudinal direction of the shim is between 0.001 mm/mm and 0.01 mm/mm.

3. The brushbar of claim 1, wherein the varying portion of the channel extends along at least half of a length of the channel.

4. The brushbar of claim 1, wherein the thickness of the flexible strip is constant along a length of the flexible strip.

5. The brushbar of claim 1, wherein the at least one retaining lip comprises a first retaining lip which extends along at least a portion of a first side of the at least one side of the channel and a second retaining lip which extends along at least a portion of a second side of the at least one side of the channel that is opposite the first side.

6. The brushbar of claim 5, wherein a distance between each retaining lip and the bottom of the channel along the varying portion of the channel decreases in the longitudinal direction of the channel.

7. The brushbar of claim 1, wherein the channel has an opening at one end of the channel for insertion of the flexible strip and the shim into the channel.

8. The brushbar of claim 7, wherein a distance between the bottom of the channel along the varying portion of the channel and the at least one retaining lip decreases in a direction away from the opening.

9. The brushbar of claim 7, further comprising an end retainer secured at the opening of the channel in order to secure the flexible strip and shim within the channel.

10. The brushbar of claim 9, wherein the end retainer comprises a cap secured to an end of the brushbar body.

11. The brushbar of claim 1, wherein a width of the varying portion of the channel decreases in the longitudinal direction of the channel and a width of the varying portion of the shim decreases along the varying portion of the shim by an amount which corresponds to the decrease in the width of the varying portion of the channel.

12. The brushbar of claim 1, wherein the agitator comprises bristles which are secured to the flexible strip.

13. The brushbar of claim 1, wherein the channel extends in a helix through at least 180 degrees.

14. A cleaner head for a vacuum cleaner comprising a brushbar, wherein the brushbar comprises:

a brushbar body comprising a channel that extends in a longitudinal direction of the brushbar and at least one retaining lip provided along at least one side of the channel and spaced away from a bottom of the channel, the channel having a varying portion in which a depth of the channel decreases from one end of the varying portion in a longitudinal direction of the channel;

an agitator element comprising a flexible strip and an agitator, wherein the flexible strip comprises a fabric and has a maximum thickness of less than 1 mm, and wherein the flexible strip is disposed in the channel and extends between the at least one retainer retaining lip and the bottom of the channel such that the at least one retaining lip retains the flexible strip in the channel and the agitator extends radially outwardly from the channel; and a shim disposed between the flexible strip and the bottom of the channel such that the flexible strip is held in abutting contact with the at least one retaining lip, wherein the shim has a varying portion in which a thickness decreases in a longitudinal direction of the shim by an amount which corresponds to the decrease in the depth of the channel.

15. A cleaning appliance comprising a brushbar, wherein the brushbar comprises:

a brushbar body comprising a channel that extends in a longitudinal direction of the brushbar and retaining lip provided along at least one side of the channel and spaced away from a bottom of the channel, the channel having a varying portion in which a depth of the channel decreases from one end of the varying portion in a longitudinal direction of the channel;

an agitator element comprising a flexible strip and an agitator, wherein the flexible strip comprises a fabric and has a maximum thickness of less than 1 mm, and wherein the flexible strip is disposed in the channel and extends between the at least one retaining lip and the bottom of the channel such that the at least one retaining lip retains the flexible strip in the channel and the agitator extends radially outwardly from the channel; and a shim disposed between the flexible strip and the bottom of the channel such that the flexible strip is held in abutting contact with the at least one retaining lip, wherein the shim has a varying portion in which a thickness decreases in a longitudinal direction of the shim by an amount which corresponds to the decrease in the depth of the channel.

16. A method of manufacturing a brushbar that comprises a brushbar body having a channel which extends generally in a longitudinal direction of the brushbar and at least one retaining lip provided along at least one side of the channel and spaced away from a bottom of the channel, the channel having a varying portion in which a depth of the channel decreases from one end of the varying portion in a longitudinal direction of the channel, the method comprising:

inserting an agitator element comprising a flexible strip and an agitator into the channel such that the flexible strip is disposed in the channel and extends between the at least one retaining lip and the bottom of the channel and the agitator extends radially outwardly from the channel, wherein the flexible strip comprises a fabric and has a maximum thickness of less than 1 mm, and;

inserting a shim between the flexible strip and the bottom of the channel such that the flexible strip is pressed into abutting contact with the at least one retaining lip, the shim having a varying portion in which a thickness decreases in a longitudinal direction of the shim by an amount which corresponds to the decrease in the depth of the channel.

17. The method of manufacturing the brushbar of claim 16, wherein the channel has an opening at one end of the channel, and the method further comprises securing an end retainer at the opening in order to retain the agitator strip and the shim within the channel.

* * * * *